United States Patent [19]

Kodaira

[11] Patent Number: 4,570,157

[45] Date of Patent: Feb. 11, 1986

[54] INFRARED INTRUSION ALARM SYSTEM CAPABLE OF PREVENTING FALSE SIGNALS

[75] Inventor: Makoto Kodaira, Tokyo, Japan

[73] Assignee: Uro Denski Kogyo, K.K., Tokyo, Japan

[21] Appl. No.: 558,764

[22] Filed: Dec. 6, 1983

[30] Foreign Application Priority Data

Apr. 20, 1983 [JP] Japan ..... 58-68451

[51] Int. Cl.[4] ..... G08B 13/18

[52] U.S. Cl. ..... 340/567; 250/340; 250/371; 340/587

[58] Field of Search ..... 340/567, 587; 250/340, 250/371, 338 P

[56] References Cited

U.S. PATENT DOCUMENTS 3,928,843 12/1975 Sprout et al. ..... 340/567

4,195,286 3/1980 Galvin ..... 340/587

*Primary Examiner*—Glen R. Swann, III

*Attorney, Agent, or Firm*—Robert E. Burns; Emmanuel J. Lobato; Bruce L. Adams

[57] ABSTRACT

An alarm device responsive to entering or trespassing comprising:

(a) a sensor circuit, including an infrared ray sensor, producing an output having positive and negative peaks based on outputs of said sensor being produced when a target to be sensed passes within the region of vision monitored by said sensor, (b) a level detecting circuit comprising a first detector producing an output when the positive peak of the output fed from said sensor circuit exceeds a predetermined level, and a second detector producing an output when the negative peak of the output fed from said sensor circuit exceeds a predetermined level, (c) a timer circuit comprising a first timer producing an output which continues for a predetermined time interval or above from a time at which the output of said first detector is produced, and a second timer producing an output which continues for a predetermined time or above from a time at which the output of said second detector is produced, (d) an AND circuit comprising a first circuit producing an output when there exist the output of said first timer and the output of said second detector at the same time, and a second circuit producing an output when there exist the output of said second timer and the output of said first detector at the same time, and (e) an output circuit responsive to the output of said AND circuit to produce an alarm signal.

8 Claims, 3 Drawing Figures

INFRARED INTRUSION ALARM SYSTEM CAPABLE OF PREVENTING FALSE SIGNALS

BACKGROUND OF THE INVENTION

The present invention relates to an alarm device or system responsive to trespassing used for prevention of crime, and more particularly to a device for effecting detection of attempted entering of premises by an unauthorized person and the like with infrared rays (which are also called "heat rays"), thereby to produce alarm signals responsive thereto.

Generally, there have been proposed various kinds of burglary preventing devices. Particularly, when, an unauthorized person such as a man is a target to be detected, a method of detecting infrared rays radiated from the human body is effective for this purpose. In accordance with this method, alarm signals are produced on the basis of the amount of infrared rays sensed and the state of the change thereof, when a person passes within the range of vision monitored by the infrared ray sensor.

However, with conventional alarm devices of the type stated above, the following drawback is pointed out. Namely, it happens that alarm signals are erroneously produced, even if there is no unauthorized person or trespasser attempting to enter a room, due to the influence of a draft admitted thereinto, a change in temperature within a room occurring due to an air-conditioner, such as, a cooler or heater, or a fan is switched off, or a change in room temperature which is caused depending on the temperature in the morning or in the evening.

As stated above, if alarm signals are erroneously produced many times, the reliability for alarm devices is lowered or lost.

SUMMARY OF THE INVENTION

An object of the present invention is to provide an alarm device for sensing entering or trespassing which is capable of securely detecting the existence of a trespasser, and capable of preventing erroneous sensing operation due to draft, noises or room temperature changes.

For the purposes of achieving these objects, an alarm device for sensing trespassing according to the present invention is constituted so as to produce alarm signals solely when the change of infrared rays reaches that corresponding to entering attempted by an unauthorized person, namely, soley when the change of the infrared rays is beyond a predetermined level within a predetermined time interval.

DETAILED DESCRIPTION OF THE INVENTION

Figure 1:
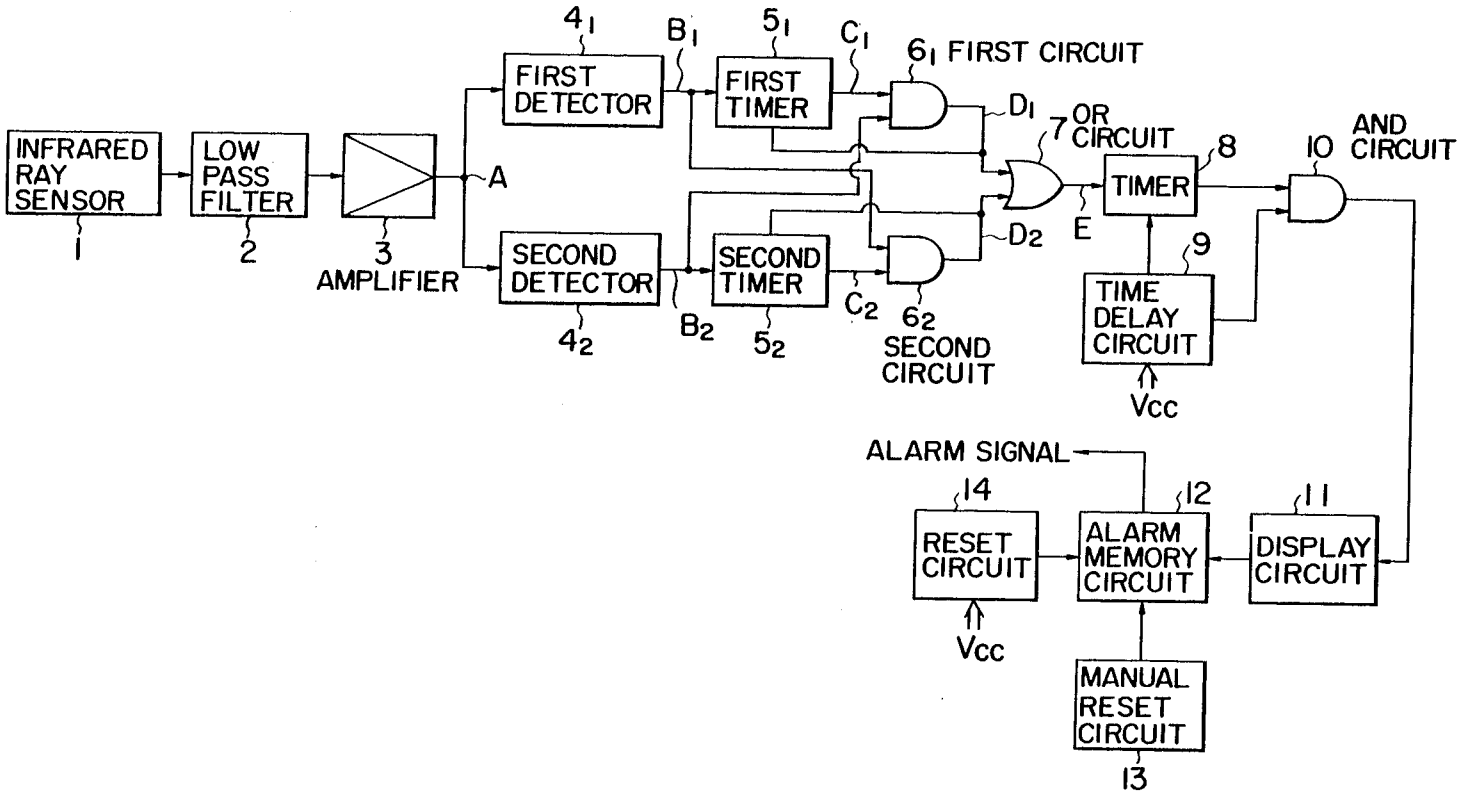
FIG. 1 is a block diagram illustrating an embodiment according to the present invention.

Referring to FIG. 1 which shows an embodiment according to the present invention, reference numeral 1 denotes an infrared ray sensor for sensing the radiated amount of the infrared ray within the range of vision to be monitored to produce an output proportional to the amount sensed. A sensor as called "pyroelectric type sensor" is generally used as this type of sensor.

The output of the infrared ray sensor 1 is fed to a low pass filter 2. Thus, solely low frequency components, such as 0 to 20 Hz are obtained as the output of the filter 2, and then the output thus obtained is fed to an amplifier 3. The reason why such low frequency components are selected is as follows: The frequency which is produced when man normally walks is about 2 Hz, and that which is produced when man runs fast is about 7 Hz. This means that the frequency higher than a predetermined frequency is irrelevant to the movement of the human being.

Signals which have been amplified by the amplifier 3 are fed to two level detectors designated by reference numerals $4_1$ and $4_2$, respectively. Thus, levels of these signal are detected and then the outputs detected therewith are fed to timers $5_1$ and $5_2$, respectively. The reason why two level detectors are provided is to effect respective level detection with respect to positive and negative polarities of the output of the amplifier 3.

Outputs of level detectors $4_1$ and $4_2$ are fed to timers $5_1$ and $5_2$, respectively. These timers $5_1$ and $5_2$ feed outputs to AND circuits $6_1$ and $6_2$ for a predetermined time interval. The signals each having an inverse polarity and no time delay, are fed to AND circuits $6_1$ and $6_2$ from level detectors $4_2$ and $4_1$, respectively. When logical multiplication is performed in these AND circuits $6_1$ and $6_2$, they produce outputs to feed outputs thus produced to a timer 8 through an OR circuit 7, and cause timers $5_1$ and $5_2$ to be reset.

The timer 8 feeds an output which is continued for a predetermined duration based on the output of the OR circuit 7 to one input of an AND circuit 10, under conditions that a signal fed from a start time delay circuit 9 is fed to the timer 8 because sufficient time has passed from a time at which the system is powered. On the other hand, the output of the start time delay circuit 9 is fed to the other input of the AND circuit 10. When the logical multiplication is performed, the AND circuit 10 feeds an output to a display circuit 11.

The display circuit 11 is provided with, for instance, an LED indicator to visually effect alarm indication, and feed an output to an alarm memory circuit 12. The alarm memory circuit 12 stores the fact that an alarm signal has been produced, and feeds an alarm signal to a monitor board not shown. This memory circuit 12 is constituted so that the content stored therein is cancelled and the sending of its output is inhibited in response to a reset signal being fed from a manual reset circuit 13 or a start reset circuit 14 which operates when the system is powered.

Figure 2:
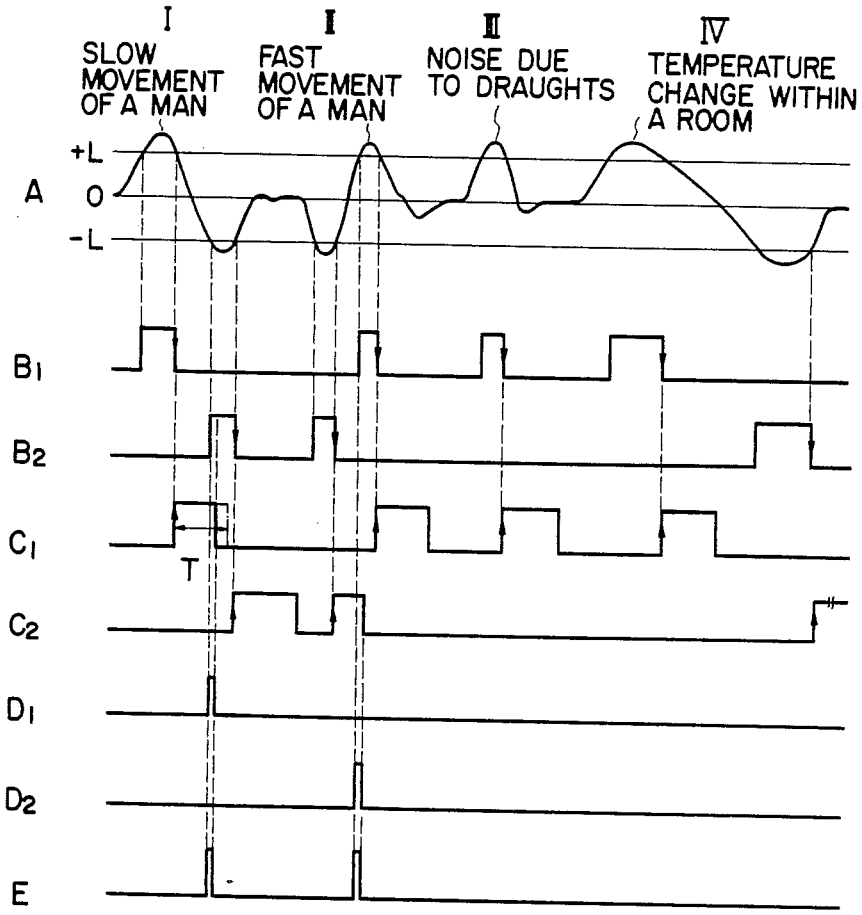
FIG. 2 shows waveforms of signals at each part of FIG. 1 circuit.

FIG. 2 shows waveforms of signals at each of circuit components shown in FIG. 1, which correspond to various kinds of content sensed by the sensor 1, respectively. Symbol A denotes an output of the amplifier 3, symbols $B_1$ and $B_2$ outputs of level detectors $4_1$ and $4_2$, respectively, symbols $C_1$ and $C_2$ outputs of timers $5_1$ and $5_2$, respectively, symbols $D_1$ and $D_2$ outputs of AND circuits $6_1$ and $6_2$, respectively, and symbol E an output of the OR circuit.

In the embodiment, the content to be sensed is classified into, for instance, four cases (I) to (IV). Case (I) shows that man moves relatively slowly, case (II) shows that man moves relatively fast, case (III) shows noise due to draughts, and case (IV) shows that there exist temperature changes within a room.

Reference is now made to each case, respectively.

(I) The case that man moves relatively slowly:

In this instance, the output A of the amplifier 3 has large amplitude with positive and negative peaks. As a result, the level detector $4_1$ produces an output $B_1$ which is placed in "H" as long as the positive peak exceeds, or is above the sensing level designated by symbol +L. On the other hand, the level detector $4_2$ produces an output $B_2$ which is placed in "H" as long as the negative peak exceeds, or is below the sensing level designated by symbol −L.

These outputs $B_1$ and $B_2$ are fed to timers $5_1$ and $5_2$, respectively. Timers $5_1$ and $5_2$ produce outputs $C_1$ and $C_2$ which rise in synchronism with the negative going edges of outputs $B_1$ and $B_2$, respectively, and each of which has time duration T at a maximum value. These outputs $C_1$ and $C_2$ are fed to AND circuits $6_1$ and $6_2$. In this instance, the output $C_1$ of the timer $5_1$ and the output $B_2$ of the level detector $4_2$ are fed to the AND circuit $6_1$. Since both outputs $C_1$ and $B_2$ overlap with each other with respect to time, the AND circuit $6_1$ produces an output $D_1$, which is fed to the OR circuit 7 and causes the timer $5_1$ to be reset. Thus, the OR circuit 7 feeds an output E to the timer 8, thereby effecting the above-described alarm operation.

(II) The case that man moves relatively fast:

This case is recognized by the sensor 1 in a manner that man moves in a direction opposite to that of case (I). For this reason, the output of the amplifier 3 varies so that subsequently to occurrence of a negative peak, a positive peak appears. Accordingly, first the level detector $4_2$ produces an output, and then an output of the level detector $4_1$ is produced. This operating relationship between detectors $4_1$ and $4_2$ is just applied to that of the corresponding timers and AND circuits. However, the state of the output E of the OR circuit 7 is the same as that of the case (I).

(III) The case of noises due to drafts:

In this instance, an output A of the amplifier 3 varies, in such a manner that solely a positive peak appears, but a peak identifiable as a negative peak does not appear. Accordingly, there occurs output $B_1$ of the level detector $4_1$, while there does not occur output $B_2$ of the level detector $4_2$. Consequently, neither of AND circuits $6_1$ and $6_2$ produces an output.

The disturbance to be generally treated as a noise has an amplitude smaller than that of drafts noise. Accordingly, in the case of normal noise, there does not occurs either of outputs of level detectors $4_1$ and $4_2$.

(IV) The case that there exists a change in temperature within a room:

When room temperature changes normally or the like, the output A of the amplifier 3 varies very slowly. In this case, even if each of positive and negative peaks appears, the occurrence thereof is limited to following condition. Namely, after the output of the level detector $4_1$ has fallen, the output $B_2$ of the level detector $4_2$ does not rise until a predetermined time interval is passed, which is remarkably longer than the time constant T of the timer $5_1$. Accordingly, neither of AND circuits $6_1$ and $6_2$ produces an output.

As understood from the description described in respect to each case (I) to (IV), the alarm device of the invention does not produce alarm signal until there occurs entering attempted by an unauthorized person or condition similar thereto.

Figure 3:
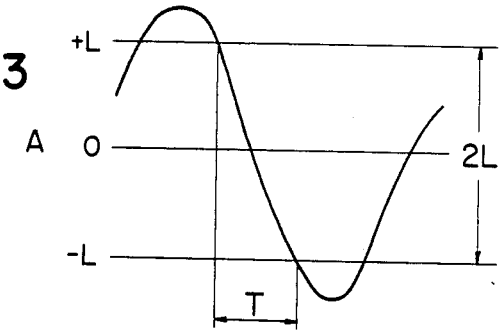
FIG. 3 is a view illustrating the operation of the alarm device according to the present invention.

FIG. 3 is a view visually showing the condition stated above, which is illustrated with an output A of the amplifier 3. Namely, the alarm device can produce alarm signal, solely when there occur such level changes or fluctuations that the output A of the amplifier 3 exceeds levels +L and −L in the positive and negative directions, respectively, within the time constant T.

As is clear from the foregoing description, the alarm device according to the present invention is constituted so as to produce an alarm signal based on the fact that changes of an infrared ray are beyond a predetermined level within a predetermined time interval. Accordingly, the device of the invention makes it possible to remarkably lessen or reduce erroneous alarms, as encountered with prior art infrared type alarm device, thereby to improve reliability.

What is claimed is:

1. An alarm device responsive to entering or trespassing comprising:

(a) a sensor circuit, including an infrared ray sensor, producing an output having positive and negative peaks based on outputs of said sensor being produced when a target to be sensed passes within the region of vision monitored by said sensor;

(b) a level detecting circuit comprising a first detector producing an output when the positive peak of the output fed from said sensor circuit exceeds a predetermined level, and a second detector producing an output when the negative peak of the output fed from said sensor circuit exceeds a predetermined level;

(c) a timer circuit comprising a first timer producing an output which continues for at least a predetermined time interval from a time at which the output of said first detector is produced, and a second timer producing an output which continues for at least a predetermined time from a time at which the output of said second detector is produced;

(d) and AND circuit comprising a first circuit producing an output when there exist the output of said first timer and the output of said second detector at the same time, and a second circuit producing an output when there exist the output of said second timer and the output of said first detector at the same time; and (e) an output circuit responsive to the output of said AND circuit to produce an alarm signal.

2. An alarm device responsive to entering or trespassing according to claim 1, wherein said sensor circuit includes a low pass filter for permitting solely low frequency components included in the output of said infrared ray sensor to pass therethrough.

3. An alarm device responsive to entering or trespassing according to claim 2, wherein said low pass filter permits signals whose frequency region ranges from 0 to 20 Hz to pass therethrough.

4. An alarm device responsive to entering or trespassing according to claim 1, wherein said output circuit becomes operative in a predetermined time interval from a time at which the device is powered.

5. An alarm device responsive to entering or trespassing according to claim 1, wherein said output circuit includes a display circuit for indicating visually the occurrence of an alarm signal.

6. An alarm device responsive to entering or trespassing according to claim 1, wherein said output circuit further includes an alarm memory circuit for memorizing that the alarm signal has been output, and a reset circuit for resetting the memory of said alarm memory circuit.

7. An alarm device responsive to entering or trespassing according to claim 6, wherein said reset circuit includes a circuit producing a reset output in response to energization of said alarm device.

8. An alarm device responsive to entering or trespassing according to claim 6, wherein said reset circuit includes circuit for manually producing a reset output.

* * * * *